US005974281A

United States Patent [19]

Fujii et al.

[11] Patent Number: 5,974,281

[45] Date of Patent: Oct. 26, 1999

[54] IMAGE FORMING APPARATUS USING INTERMEDIATE TRANSFER MEMBER

[75] Inventors: Haruo Fujii, Yokohama; Koichi Hiroshima, Shizuoka-ken; Hideyuki Yano, Numazu, all of Japan

[73] Assignee: Canon Kabushiki Kaisha, Tokyo, Japan

[21] Appl. No.: 09/103,582

[22] Filed: Jun. 24, 1998

[30] Foreign Application Priority Data

Jun. 27, 1997 [JP] Japan ..... 9-172485

[51] Int. Cl.[6] ..... G03G 15/16; G03G 15/01

[52] U.S. Cl. ..... 399/66; 399/302; 399/308; 399/310

[58] Field of Search ..... 399/302, 308, 399/66, 110, 297, 310, 315, 313, 314

[56] References Cited

U.S. PATENT DOCUMENTS

| | | | |
|---|---|---|---|
| 5,438,398 | 8/1995 | Tanigawa et al. . | |
| 5,598,256 | 1/1997 | Kimura et al. | 399/66 X |
| 5,884,121 | 3/1999 | Kyung | 399/66 |
| 5,893,661 | 4/1999 | Sakai et al. | 399/66 |
| 5,905,013 | 5/1999 | Seto | 399/308 X |

FOREIGN PATENT DOCUMENTS 5-333725 12/1993 Japan .

*Primary Examiner*—Matthew S. Smith

*Attorney, Agent, or Firm*—Fitzpatrick, Cella, Harper & Scinto

[57] ABSTRACT

The present invention provides an image forming apparatus for forming an image on a transfer material by using an intermediate transfer member, having a first transfer bias power supply for applying transfer bias to a first transfer unit to generate first transfer bias between a photosensitive member and an intermediate transfer member, when toner images are successively firstly-transferred onto the intermediate transfer member, and a second transfer bias power supply for providing constant current to generate second transfer bias between the intermediate transfer member and the secondary transfer electrode, and wherein the second transfer bias power supply applies, in an overlap fashion, transfer bias of current having a current value greater than a current value of the transfer bias to be applied to an upstream image area of the transfer material and having the same polarity as that of the latter transfer bias to at least a non-image area of the transfer material at an end portion thereof in a transfer material conveying direction, thereby preventing the toner images from scattering.

38 Claims, 6 Drawing Sheets

IMAGE FORMING APPARATUS USING INTERMEDIATE TRANSFER MEMBER

BACKGROUND OF THE INVENTION

1. Field of the Invention

The present invention relates to an image forming apparatus such as a copying machine, a printer, a facsimile and the like, utilizing an electrophotographic process.

2. Related Background Art

Among image forming apparatuses utilizing an electrophotographic process, in a type in which a transfer belt is used as a transfer means for transferring a toner image onto a transfer material at a transfer station, the transfer belt has a function for transferring the toner image onto the transfer material, a function for separating the transfer material after the transferring and a function for conveying the separated transfer material.

Generally, since a peripheral or circumferential length of the transfer belt is smaller than a length of the transfer material in a conveying direction thereof, when the toner image is transferred onto the transfer material, it is insufficient to rotate the transfer belt by one revolution, and second revolution of the belt also contributes to the transferring. Thus, in order to prevent "charge-up" phenomenon, in which charges having polarity opposite to polarity of transfer bias applied to the transfer belt during the first revolution of the belt are accumulated on the surface of the transfer belt, from affecting a bad influence upon the image, constant-current-controlled transfer bias has been applied to the transfer belt.

In the conventional image forming apparatuses in which the constant current is used as the transfer bias for the transfer belt, if resistance of the transfer material itself is increased due to low humidity environment, when the toner (developer) image is transferred onto the transfer material, for example, in an image forming apparatus having an intermediate transfer member 7 and a transfer belt 8 as shown in FIG. 8, if an area of a secondary transfer station (transfer nip) of the intermediate transfer member 7 (which is contacted with the transfer belt 8 and at which the firstly-transferred toner image T is secondary-transferred onto the transfer material) is great, the secondary transfer station (transfer nip) extends over both the transfer material P and the intermediate transfer member 7, with the result that, at a rear end part P1 (downstream end in a conveying direction) of the transfer material P (which part is a non-image area where the toner image is not existed), load impedance is suddenly decreased to reduce transfer voltage (having positive polarity), thereby reducing an amount of charges (having positive polarity) applied to the back surface of the transfer material P.

Incidentally, the firstly transfer bias having positive polarity is applied to the intermediate transfer member 7 and the toner T to be transferred to the transfer material P is charged with negative polarity. Further, in FIG. 8, at the secondary transfer station (transfer nip), although the intermediate transfer member 7 is shown to have a flat configuration, the intermediate transfer member is actually formed as a drum.

As mentioned above, at the rear end part P1 (non-image area) of the transfer material P, since the amount of the charges (having positive polarity) applied to the back surface of the transfer material P is reduced, as shown in FIG. 8, the charges (having positive polarity) for holding the toner T (having positive polarity) applied to the back surface of the transfer material P is partially reduced.

As a result, after the transferring, when the transfer material P is separated from the transfer belt 8, peel discharge is generated between the transfer material P and the transfer belt 8. Consequently, at the rear end part P1 of the transfer material P having the reduced charges for holding the toner, as shown in FIG. 9, the toner is scattered due to discharge shock.

SUMMARY OF THE INVENTION

An object of the present invention is to provide an image forming apparatus in which sudden reduction of voltage is suppressed at a rear end or non-image area of a transfer material during transferring to prevent scattering of toner.

To achieve the above object, according to the present invention, there is provided an image forming apparatus for forming a toner image on a transfer material by using an intermediate transfer member, comprising an image bearing member, a toner image forming means for forming a toner image on the image bearing member, a transfer means contacted with the image bearing member and shifted along an endless path and for transferring the toner image formed on the image bearing member onto the transfer material, and a transfer bias power supply connected with the transfer means and using constant current for generating transfer bias between the image bearing means and the transfer means, and the transfer bias power supply applies, in an overlap fashion, as the transfer bias, current having a current value greater than a current value of the transfer bias to be applied to an upstream image area of the transfer material and having the same polarity as that of the latter transfer bias to a non-image area of the transfer material at an end portion thereof in a transfer material conveying direction.

The image bearing member may be an electrophotographic photosensitive member or an intermediate transfer member.

DETAILED DESCRIPTION OF THE PREFORMED EMBODIMENTS (First Embodiment)

Figure 1:
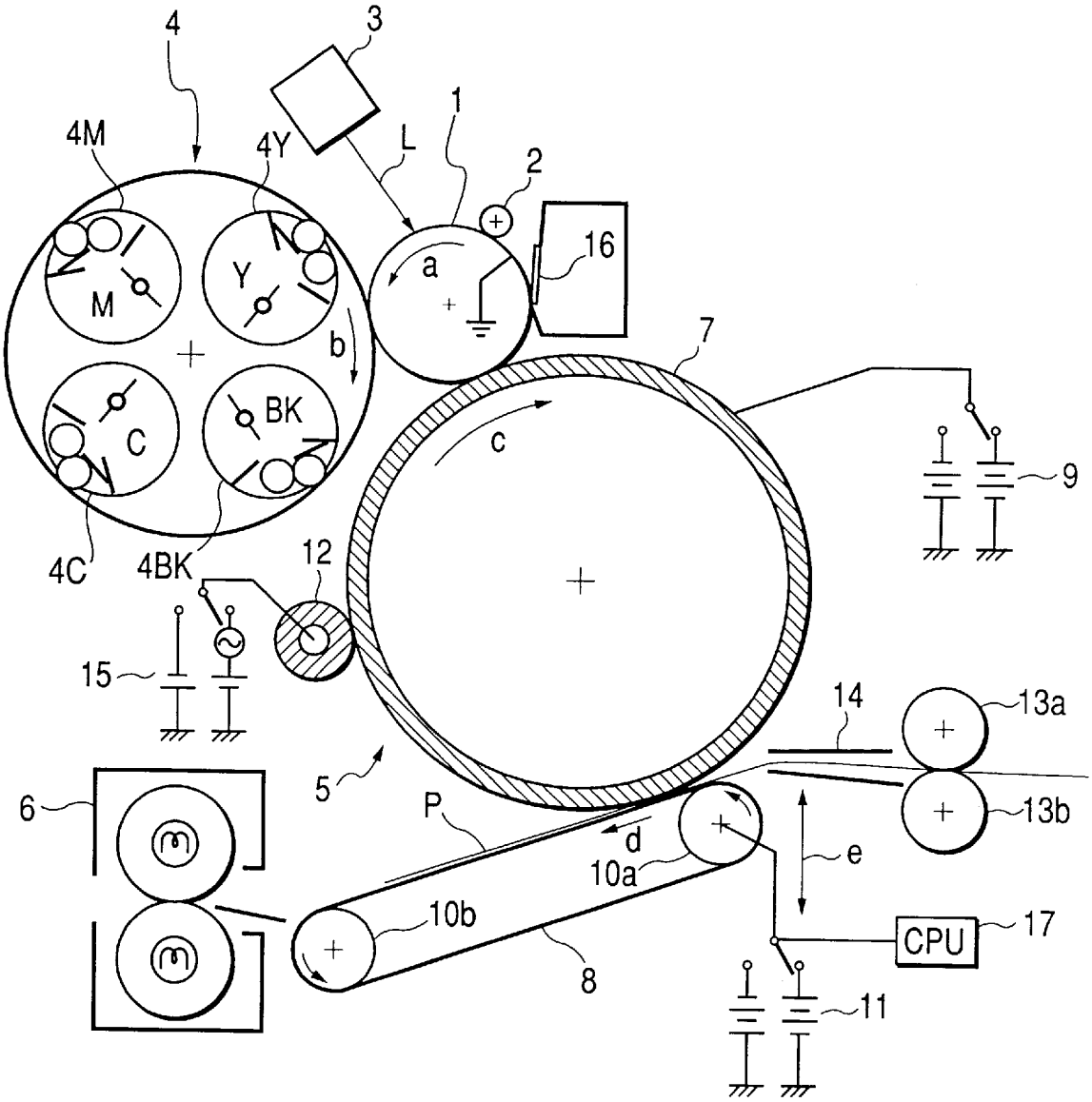
FIG. 1 is a schematic view showing an image forming apparatus according to a first embodiment of the present invention.

FIG. 1 is a schematic view of an image forming apparatus (laser beam printer capable of forming a color image, in a first embodiment).

The image forming apparatus comprises a drum-shaped photosensitive member 1, a charging roller 2, an exposure device 3, a developing means 4, a transfer device 5 and a fixing device 6.

In the illustrated embodiment, the photosensitive member 1 is constituted by an aluminum drum base having a diameter of 60 mm and a negatively charged OPC photoconductive layer coated on the drum base and is rotated at a process speed of 105 mm/sec in a direction shown by the arrow a.

The charging roller 2 is urged against the photosensitive member 1 with predetermined pressure and is rotatingly driven by rotation of the photosensitive member 1. The charging roller serves to uniformly charge the photosensitive member 1 with predetermined polarity and potential by applying predetermined charging bias (for example, voltage obtained by overlapping AC voltage with DC voltage) from a power supply (not shown) to the charging roller 2.

The developing means 4 includes a yellow color toner developing device 4Y, a magenta color toner developing device 4M, a cyan color toner developing device 4C and a black color toner developing device 4BK and is rotated by a rotation driving device (not shown) so that a selected one of the yellow color toner developing device 4Y, magenta color toner developing device 4M, cyan color toner developing device 4C and black color toner developing device 4BK is opposed to the photosensitive member 1 during development.

The transfer device 5 includes a drum-shaped intermediate transfer member 7 onto which toner images on the photosensitive member 1 are transferred, and a transfer belt (secondary transfer means) 8. The intermediate transfer member 7 is contacted with a surface of the photosensitive member 1 (to form a firstly transfer station) and is also contacted with a surface of the transfer belt 8 (to form a secondary transfer station) and is rotated in a direction shown by the arrow c. The intermediate transfer member 7 is constituted by a drum-shaped conductive base member and a dielectric layer coated on the base member. A firstly transfer bias power supply 9 is connected to the base member so that predetermined firstly transfer bias can be applied to the intermediate transfer member 7.

The transfer belt 8 is mounted around and between a transfer roller 10*a* and a drive roller 10*b* in a tension condition and is rotated by the drive roller 10*b* so that an upper run of the belt is shifted in a direction shown by the arrow d. The transfer belt 8 is shifted by a drive means (not shown) in a direction shown by the arrow e to be engaged by and disengaged from the intermediate transfer member 7. A secondary transfer bias power supply 11 is connected to the transfer roller 10*a* so that predetermined secondary transfer bias can be applied to the transfer roller 10*a*.

A control device (CPU) 17 is connected to the secondary transfer bias power supply 11. The control device controls, with constant current, the secondary transfer bias to be applied to the transfer roller 10*a* (fully described later).

Next, an image forming operation of the image forming apparatus will be described.

In the image formation, the photosensitive member 1 is rotated by a drive means (not shown) at the process speed of 105 mm/sec and is charged with the predetermined polarity and potential by the charging roller 2 to which the predetermined charging bias (voltage obtained by overlapping AC voltage with DC voltage) was applied.

Image exposure (laser beam) L is applied from the exposure device 3 to the charged photosensitive member 1 to form an electrostatic latent image corresponding to a first color component image of a target color image (for example, yellow color component image). Then, the electrostatic latent image is developed by the yellow color toner developing device 4Y of the developing means 4 to form a first or yellow toner image.

While the first yellow toner image born on the photosensitive member 1 is being passed through a nip (firstly transfer station) formed between the photosensitive member 1 and the intermediate transfer member 7, the toner image is firstly-transferred onto an outer peripheral surface of the intermediate transfer member 7 by pressure at the nip (firstly transfer station) and an electric field generated by the firstly transfer bias applied from the firstly transfer bias power supply 9 between the intermediate transfer member 7 and the photosensitive member 1.

Similarly, a latent image corresponding to a second magenta color component image is formed on the photosensitive member 1. On the other hand, the developing means 4 is rotated by the rotation driving device (not shown) in the direction b to shift the magenta color toner developing device 4M to the position where the developing device 4M is opposed to the photosensitive member 1. Then, as is in the yellow toner image, the magenta toner image is transferred onto the intermediate transfer member 7 in a superimposed fashion. Similarly, a cyan toner image is formed by the cyan color toner developing device 4C and a black toner image is formed by the black color toner developing device 4BK, and these images are successively transferred onto the intermediate transfer member 7 in a superimposed fashion, thereby forming a full-color toner image corresponding to the target color image. The above-mentioned series of steps are called as "firstly transferring". During the firstly transferring, the firstly transfer bias applied from the firstly transfer bias power supply 9 to the intermediate transfer member 7 having (positive) polarity opposite to that of the toner.

A transfer material P such as a paper sheet supplied from a sheet supply cassette (not shown) is sent to the transfer nip (secondary transfer station) between the intermediate transfer member 7 and the transfer belt 8 through regist rollers 13*a*, 13*b* and a pre-transfer guide 14. In this case, the secondary transfer bias is applied from the secondary transfer bias power supply 11 to the transfer roller 10*a*, with the result that full-color toner images (comprised of four color toner images) are collectively transferred from the intermediate transfer member 7 to the transfer material P. This step is called as "secondary transferring".

The transfer material P to which the composite color toner images were transferred is conveyed, by the transfer belt 8, to the fixing device 6, where the toner images are fixed to the transfer material by heat and pressure. Thereafter, the transfer material is discharged out of the apparatus.

After the secondary transferring, residual toner remaining on the intermediate transfer member 7 is charged with positive polarity opposite to normal polarity of the toner by an intermediate transfer member cleaning roller 12 to which cleaning bias (obtained by overlapping AC voltage with DC voltage) was applied from a power source 15. As a result, the residual toner on the intermediate transfer member 7 is electrostatically absorbed by the photosensitive member 1, thereby cleaning the intermediate transfer member 7. On the other hand, the residual toner absorbed by the photosensitive member 1 is removed and collected by a cleaning blade 16 for the photosensitive member 1.

Figure 2:
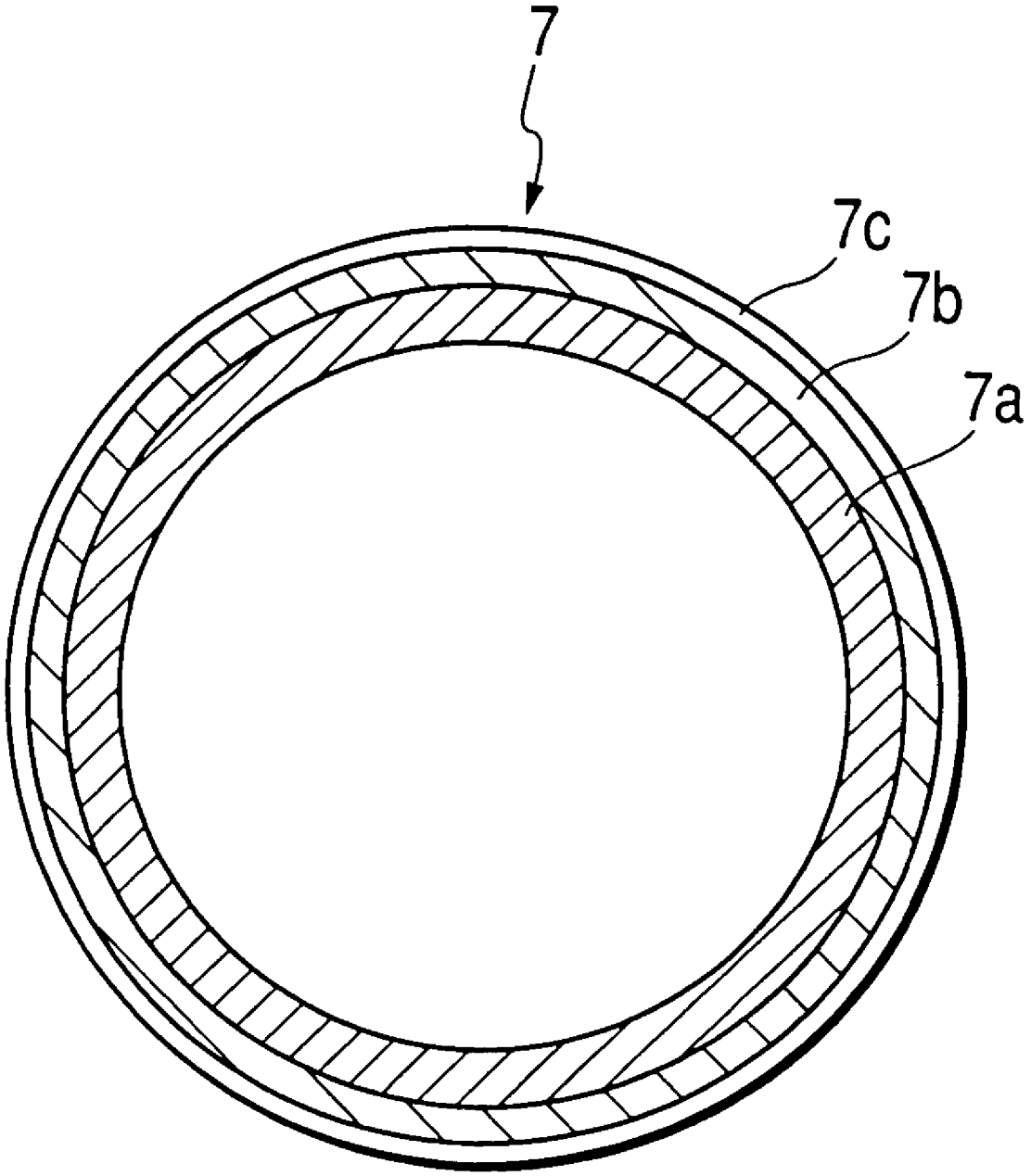
FIG. 2 is a sectional view of an intermediate transfer member of the image forming apparatus according to the first embodiment.

FIG. 2 is a schematic view of the intermediate transfer member 7. In the illustrated embodiment, the intermediate transfer member is constituted by a cylindrical conductive support (base member) 7*a* made of aluminum and having a thickness of 3 mm, an elastic layer (dielectric body) 7*b* having a thickness of 5 mm coated on the support, and a surface layer (coating layer) 7*c* having a thickness of 15 μm coated on the elastic layer. The entire intermediate transfer member 7 has an outer diameter of 180 mm. It is desirable that the thickness of the elastic layer 7*b* is selected to about 0.5 to 7 mm (preferably, 2 to 4 mm) in consideration of the formation of the transfer nip, color deviation due to rotation and cost of material and the thickness of the surface layer 7*c* is selected to about 5 to 30 μm (preferably, 10 to 20 μm) to transmit the softness of the underlying elastic layer 7*b* to the photosensitive member 1.

The elastic layer 7*b* is formed by mixing epichlorohydrin rubber with the acrylonitrile-butadience rubber (NBR) to adjust the resistance value to $10^5$ to $10^6$ Ω. The surface layer 7*c* is formed by dispersing aluminum borate wisker (as conductive material for resistance control) and PTFE powder (for improving mold releasing ability) into urethane resin (as binder).

Figure 3:
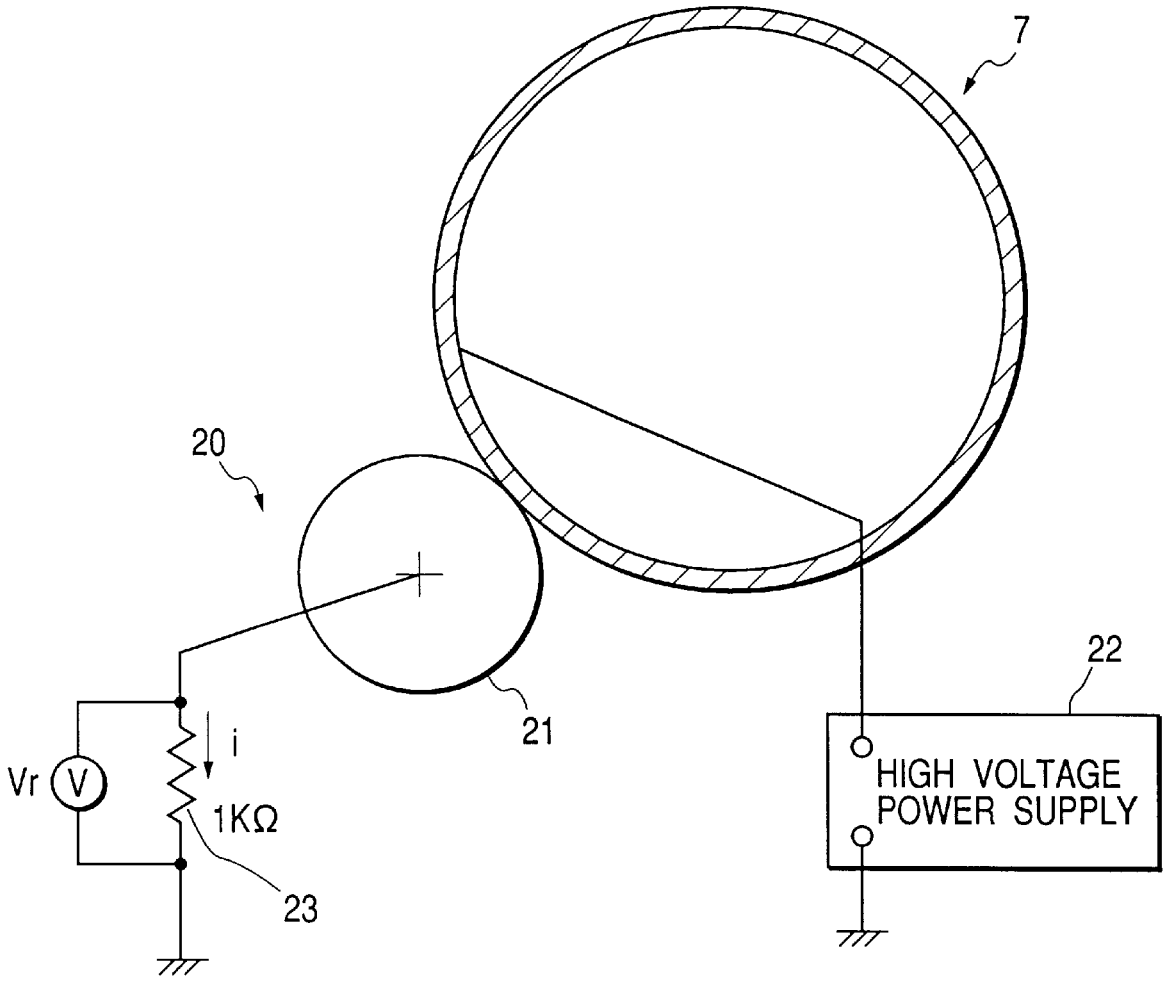
FIG. 3 is a schematic view showing a resistance measuring device for measuring resistance of the intermediate transfer member.

Incidentally, the resistance value of the intermediate transfer member 7 is measured by a measuring device shown in FIG. 3. The measuring device 20 comprises an aluminum cylinder 21 to be contacted with the intermediate transfer member 7, a high voltage power supply 22, and a standard resistance 23.

When the resistance value of the intermediate transfer member 7 is measured, the aluminum cylinder 21 is rotated by a drive means (not shown) to rotate the contacted intermediate transfer member 7 by rotation of the aluminum cylinder. In this case, the contact pressure is selected to about 1 Kgf similar to the actual image formation. By applying AC voltage from the high voltage power supply to the conductive support 7*a* of the intermediate transfer member 7, the current flowing through the elastic layer 7*b* of the intermediate transfer member 7 flows into the aluminum cylinder 21 and is grounded through the standard resistance (1 KΩ).

When the voltage between both ends of the standard resistance 23 is Vr [V], the resistance value Rc of the intermediate transfer member 7 is determined by the following equation:

$$Rc[\Omega]=10^6/Vr[V]$$

Further, regarding the resistance value of the surface layer 7*c* of the intermediate transfer member 7, by preparing the elastic layer 7*b* having dimension of 100×100 mm and by measuring the resistance by using R8340 and R12704 (machine name) manufactured by Advantest Inc. under the conditions of applied voltage=1 kV, discharge=5 sec, charge=30 sec and measure=30 sec, it was found that the resistance value of the surface layer 7*c* is $10^{10}$ Ω/□. Further, the resistance value including the elastic layer 7*b* and the surface layer 7*c* was $2\times10^7$ Ω (when voltage of 300 V was applied).

Next, the construction of the transfer belt 8 will be explained.

Figure 4:
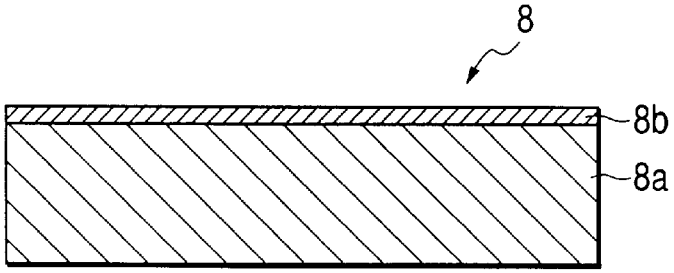
FIG. 4 is a sectional view of a transfer belt of the image forming apparatus according to the first embodiment.

FIG. 4 is a schematic sectional view of the transfer belt 8. The transfer belt is constituted by a base layer 8*a*, and a thin surface layer 8*b* coated on the base layer, and the resistance of the entire transfer belt 8 is reduced so that the transfer voltage does not become too high.

The base layer 8*a* is formed from thermosetting urethane elastomer to satisfy mechanical properties such as bending feature, tensile strength and the like. The thermosetting urethane elastomer belongs to other group. In general, although the ether group is hard to be subjected to hydrolysis in comparison with ester group, since the surface roughness is improved by centrifugal formation, the ether group has good tack feature. In the actual image formation, the surface having good tack feature is arranged inwardly to be slidingly contacted with the drive roller 10*b*, thereby reducing driving loss. The surface layer 8*b* is formed from fluorine denaturation resin so that there is no problem regarding the tack feature in the actual image formation.

As a result, in a condition that the transfer belt 8 is mounted between the transfer roller 10*a* and the drive roller 10*b* with elongation of 7%, the transfer belt 8 does not generated hunting and offset and can be used for a long term. Since the surface layer 8*b* of the transfer belt 8 is formed from fluorine denaturation resin having good mold releasing ability, even if the toner is adhered to the transfer belt 8 due to abnormality such as sheet jam, by applying positive bias and negative bias to the transfer belt 8 alternately, the toner on the transfer belt 8 can be transferred onto the intermediate transfer member 7 completely, thereby cleaning the surface of the transfer belt 8.

Next, material and electrical property of the transfer belt 8 will be explained.

First of all, fluorine denaturation resin of solution-soluble type having a thickness of 30 μm was cast-formed on the surface layer 8*b* by using a centrifugal forming mold having an inner diameter of 70 mm, and then, thermosetting urethane elastomer (for example, ENDURE (trade name) manufactured by INOAC Co.) was formed inwardly to control volume resistivity to $10^7$ Ω·cm by dispersing carbon. Further, the thickness of the belt was selected to 0.3 mm and the resistance of the entire belt was adjusted to $10^{10}$ Ω.

In the molding of the surface layer 8*b*, a rotational speed of the mold was selected to 3000 rpm, a curing temperature was selected to 150° C. and curing time was selected to three hours. In the molding of the underlying surface 8*a*, a rotational speed of the mold was selected to 3000 rpm, a curing temperature was selected to 150° C. and curing time was selected to one hour.

Further, the resistance value of the transfer belt 8 was determined by preparing a sheet of the transfer belt 8 having dimension of 100×100 mm and by measuring the resistance by using R8340 and R12704 (machine name) manufactured by Advantest Inc. under the conditions of applied voltage=100 V, discharge=5 sec, charge=30 sec and measure=30 sec.

Next, a belt property of the transfer belt 8 affecting an influence upon separation ability for the transfer material P such as a paper sheet will be explained.

There is a case where the process speed is great and, in lateral conveyance of A4 size (JIS standard) paper sheet (transfer material P), mesh of the paper becomes lateral mesh (longitudinal mesh regarding a longitudinal direction of the paper). In such a case, when the diameter of the intermediate transfer member 7 is great, as is in the conventional case, the paper sometimes cannot be separated effectively only by means of the transfer roller. The reason is that the separation of paper is effected by utilizing curvature separation generated by resiliency (elasticity) of the paper and gravity force, and, regarding the physical force, the force of the transfer material itself tending to be separated is considerably smaller than the electrostatic absorbing force of the transfer material to the intermediate transfer member 7. Further, in the past, it was found that the separation of the transfer material from the photosensitive member having a large diameter greatly depends upon the resistance of the transfer material.

If the paper (transfer material) is wetted to reduce the resistance thereof under a high temperature/high humidity condition (H/H; room temperature of 30° C., humidity of 80% Rh), since the charges cannot be held by the paper itself and leaks, the separating ability cannot be ensured except when the resistance of the surface layer 8*b* of the transfer belt 8 is increased so that the charges can be held by the surface layer 8*b*. Accordingly, by increasing the resistance of the surface layer 8*b* of the transfer belt 8 and reducing the resistance of the base layer 8*a* to increase the electrostatic capacity of the transfer belt 8, the electrostatic absorbing force is increased to achieve the separation of the paper.

However, if the paper is dried under a low temperature/low humidity condition (L/L; room temperature of 15° C., humidity of 10% Rh), since the charges can be held by the paper itself because of high electrical resistance of the paper, the paper is absorbed to either the intermediate transfer member 7 or the transfer belt 8 which has greater electrostatic capacity. Accordingly, in comparison with the H/H condition, the separation of the paper can be facilitated, but, the charges having polarity opposite to that of the transfer bias applied from the paper are accumulated on the surface of the transfer belt 8, with the result that the transfer material itself is charged-up.

Consequently, the electrostatic absorbing force of the surface layer 8*b* of the transfer belt 8 is decreased to worsen the separating ability. Thus, in order to obtain the stable separating ability for the paper, the charge-up of the transfer belt 8 must be suppressed.

To achieve this, in the present invention, the secondary transfer bias applied from the secondary transfer bias power supply 11 to the transfer roller 10*a* of the transfer belt 8 is controlled by the control device (CPU) 17 with constant current. In this case, as mentioned above, the conventional example, during the transferring operation, in the nip (secondary transfer station) between the intermediate transfer member 7 and the transfer belt 8, sudden reduction in voltage was generated at the rear end portion (non-image area) P1 of the transfer material P to lose balance between the charges of-the transfer material P and the charges of the toner T at once, thereby scattering the toner T at the rear end portion P1 of the transfer material P. In the present invention, in order to prevent the scattering of the toner T at the rear end portion P1 of the transfer material P, the secondary transfer bias applied from the secondary transfer bias power supply 11 to the transfer roller 10*a* of the transfer belt 8 is controlled by the control device (CPU) 17 in the following manner.

Figure 5:
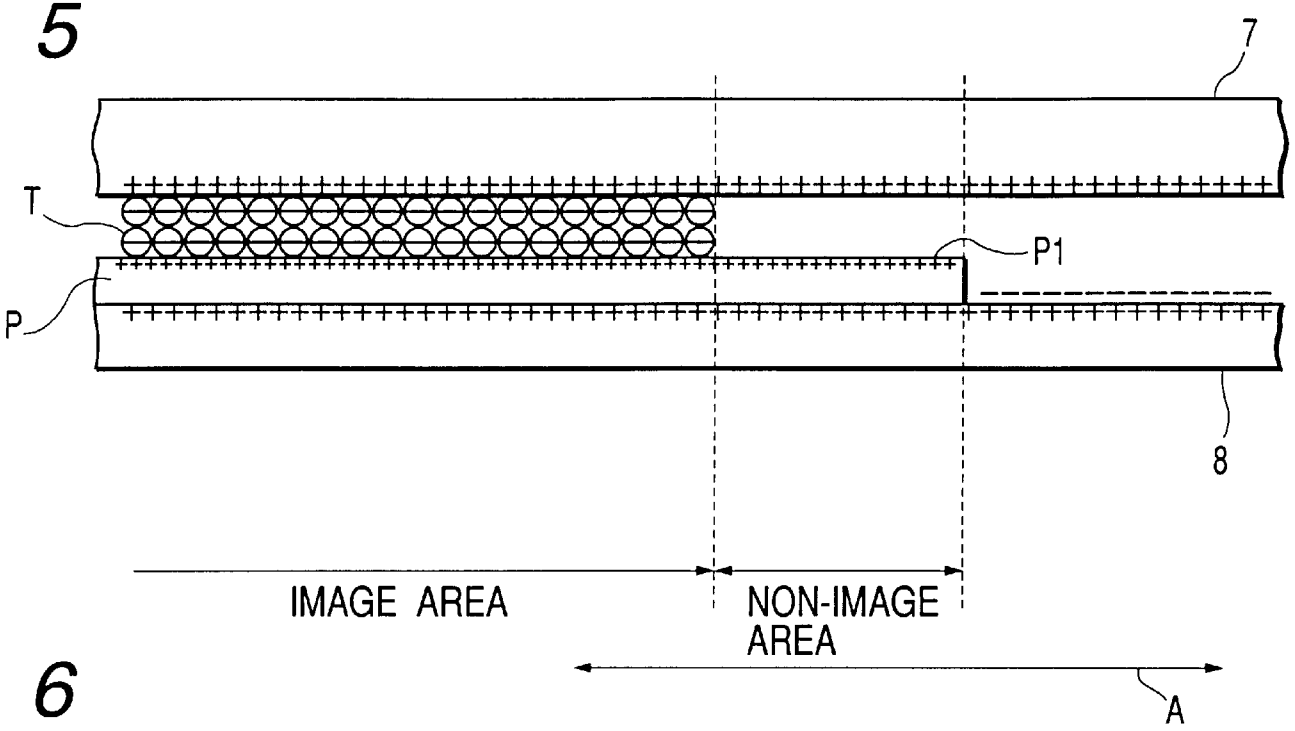
FIG. 5 is a view showing charges in a transfer nip during transferring, according to the first embodiment.

That is to say, as shown in FIG. 5, the control device (CPU) 17 controls so that secondary transfer bias having a current value greater than that of the normal constant current secondary transfer bias applied to the image area of the transfer material P by several times and having the same polarity (positive polarity) as the normal secondary transfer bias is applied to the rear end portion (non-image area) P1 of the transfer material P. Incidentally, the secondary transfer bias has polarity opposite to polarity (negative polarity) of the toner T.

More specifically, when the normal constant current secondary transfer bias applied to the image area of the transfer material P was selected to 20 $\mu$A, voltage generated on the transfer material P was about 2.5 KV. The overlapping of the secondary transfer bias having the current value (about 70 $\mu$A, as will be described later) greater than the current value (20 $\mu$A) of the normal constant current secondary transfer bias and having the same polarity (positive polarity) as the normal secondary transfer bias was effected in a range (area A in FIG. 5) spaced apart from the rear end P1 of the transfer material P by about 3 to 10 mm. In this case, the secondary transfer bias overlapped at the area A was selected to a current value to generate voltage of about 2.5 KV in a non-load condition (absence of the transfer material P), and, in the illustrated embodiment, constant current of about 70 $\mu$A was applied as the transfer bias.

In this way, by applying the secondary transfer bias having the current value greater than that of the normal constant current secondary transfer bias applied to the image area of the transfer material P by several times and having the same polarity (positive polarity) as the normal secondary transfer bias to the rear end portion (non-image area) P1 of the transfer material P in an overlapped fashion, the sudden reduction in voltage at the rear end portion P1 of the transfer material P can be suppressed.

More specifically, the current value is determined on the basis of a ratio between the resistance value of the transfer means and the resistance value of the transfer material P, and, in the low temperature condition, since both the surface layer of the transfer belt 8 and the transfer material P have resistance values generating a substantially insulation condition, the resistance values are determined on the basis of the thicknesses thereof. In the illustrated embodiment, since the thickness of the surface layer of the transfer belt 8 is 30 $\mu$m and the thickness of the paper (transfer material P) used is 60 to 300 $\mu$m, it is desirable that the constant current value applied to the rear end portion P1 of the transfer material P is selected to 60/30 to 300/30 (2 to 10 times).

Figure 6:
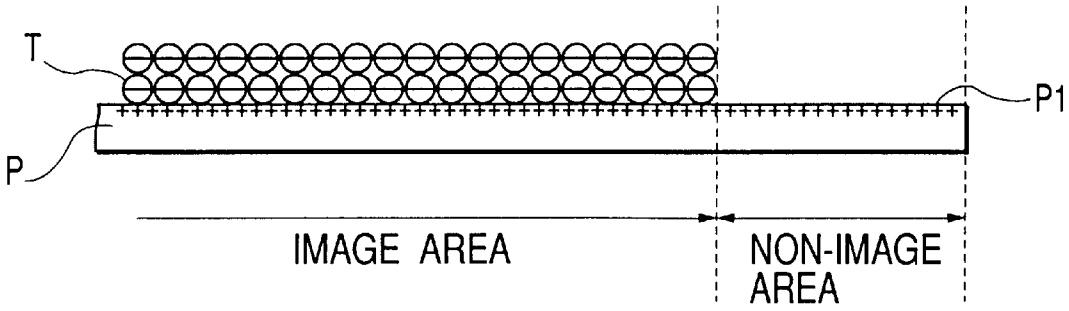
FIG. 6 is a view showing charges at a rear end portion of a transfer material in the transfer nip during transferring, according to the first embodiment.

Accordingly, as shown in FIG. 6, the balance between the charges on the rear end portion (non-image area) P1 of the transfer material P and the charges of the toner T is not lost, thereby preventing the scattering of the toner T at the rear end portion P1 of the transfer material P.

(Second Embodiment)

Figure 7:
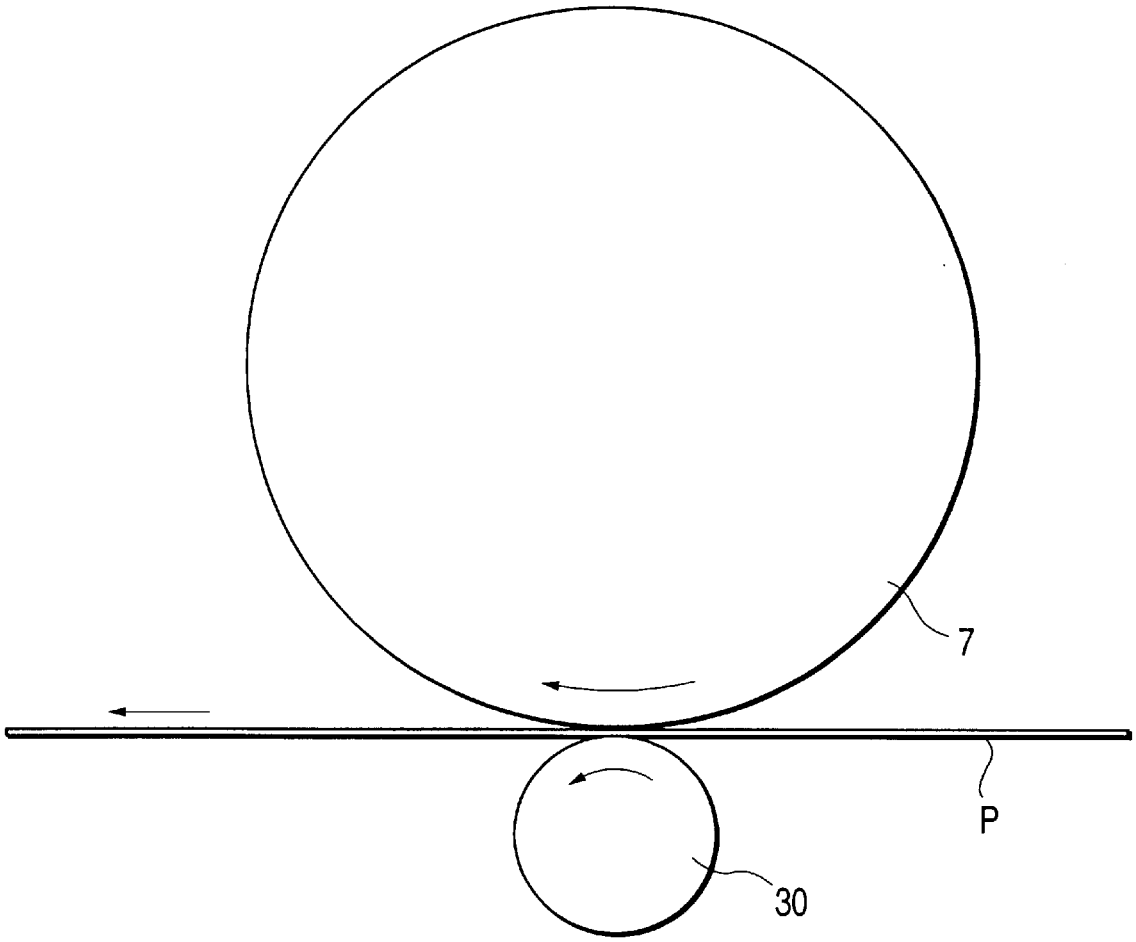
FIG. 7 is a schematic view showing an intermediate transfer member and a transfer roller of an image forming apparatus according to a second embodiment of the present invention.
Figure 8:
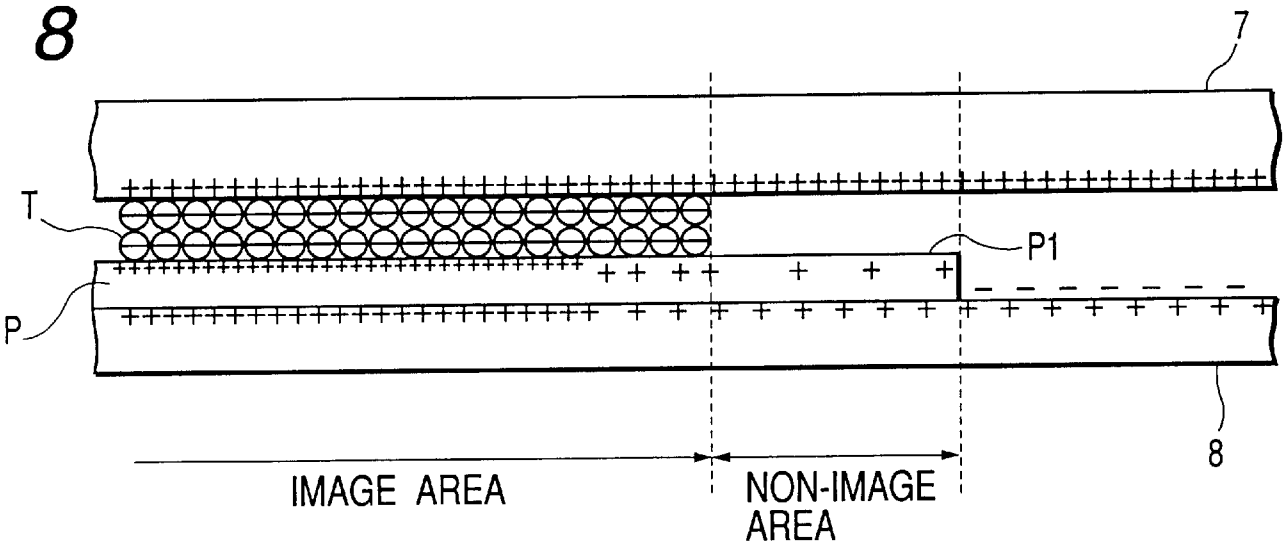
FIG. 8 is a view showing charges in a transfer nip during transferring, according to a conventional example.
Figure 9:
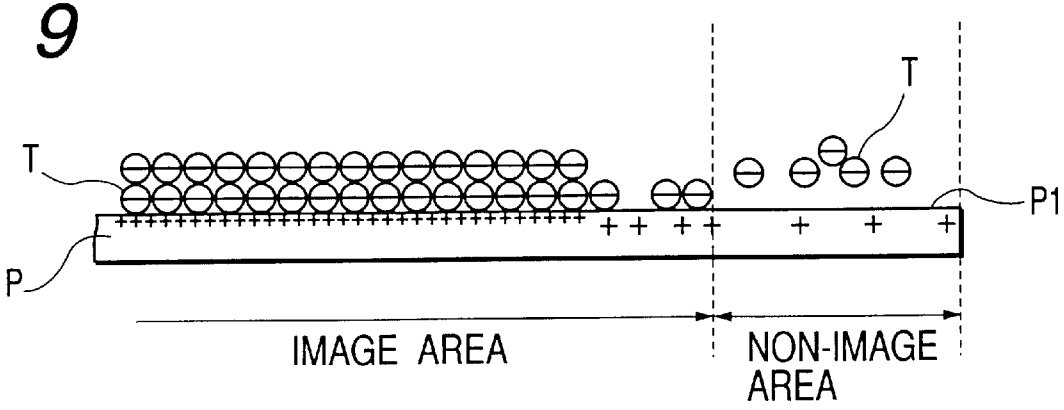
FIG. 9 is an explanatory view for explaining scattering of toner during separation of a transfer material after the transferring in the conventional example.

In the first embodiment, while an example that the transfer belt 8 is used as the secondary transfer member was explained, in a second embodiment of the present invention, as shown in FIG. 7, a transfer roller 30 is used as a secondary transfer member contacted with the intermediate transfer member 7. The other constructions are the same as those in the first embodiment.

Also in the second embodiment, during the transferring operation, at a nip (secondary transfer station) between the intermediate transfer member 7 and the transfer roller 30, the control device (not shown) controls so that secondary transfer bias having a current value greater than that of the normal constant current secondary transfer bias applied to the image area of the transfer material P by several times and having the same polarity (positive polarity) as the normal secondary transfer bias is applied to the rear end portion (non-image area) P1 of the transfer material P in an overlapped fashion. As a result, sudden reduction in voltage at the rear end portion of the transfer material P, thereby preventing the scattering of the toner at the rear end portion of the transfer material P.

As mentioned above, according to the illustrated embodiments, by effecting the constant current control so that secondary transfer bias having a current value greater than that of the normal constant current secondary transfer bias applied to the image area of the transfer material by several times and having the same polarity as the normal secondary transfer bias is applied to the rear (in the conveying direction) end portion (non-image area) of the transfer material in an overlapped fashion, since the reduction in voltage at the rear (in the conveying direction) end portion (non-image area) of the transfer material can be suppressed, and, thus, the balance between the charges on the rear end portion (non-image area) of the transfer material and the charges of the toner is not lost, thereby preventing the scattering of the toner at the rear end portion of the transfer material and obtaining the good image.

Incidentally, in the illustrated embodiments, while an example that the transfer current is increased at the downstream side of the transfer material in the conveying direction was explained, in the present invention, the transfer current may be increased in an non-image area at an upstream side of the transfer material. Further, the present invention can be applied to both the non-image areas at upstream and downstream sides of the transfer material.

Further, in the illustrated embodiments, while an example that the present invention is applied to the apparatus using the intermediate transfer member was explained, as another example, the present invention may be applied to an apparatus in which a toner image formed on a photosensitive member is directly transferred onto a transfer material. In this case, by replacing the intermediate transfer member 7 of the apparatus shown in FIG. 1 by the photosensitive member 1, the construction of another apparatus can easily be guessed.

Also in the apparatus in which the toner image formed on the photosensitive member is directly transferred onto the transfer material, when plural color toner images are formed on the photosensitive member, as is in the embodiment shown in FIG. 1, the scattering of toner at the end of the transfer material can be prevented effectively.

The present invention is effective to prevent the scattering of toner in an apparatus (as shown in the embodiments) in which the plural color toner images are transferred in the superimposed fashion and are collectively transferred onto the transfer material. That is to say, the present invention is particularly effective since, if the thickness of the toner images to be transferred becomes great, the possibility of scattering of toner is increased.

What is claimed is:

1. An image forming apparatus for forming an toner image on a transfer material by using an intermediate transfer member, comprising:

an image bearing member;

a toner image forming means for forming a toner image on said image bearing member;

a transfer means contacted with said image bearing member and shifted endlessly for transferring the toner image formed on said image bearing member onto the transfer material; and a transfer bias power supply connected with said transfer means and using constant current, for generating transfer bias between said image bearing member and said transfer means;

wherein said transfer bias power supply applies, to at least a non-image area of the transfer material at an end portion thereof in a transfer material conveying direction, in an overlap fashion, transfer bias of current having a current value greater than a current value of the transfer bias to be applied to an upstream image area of the transfer material by two to ten times and having the same polarity as that of the transfer bias to be applied to the upstream image area of the transfer material.

2. An image forming apparatus according to claim 1, wherein said transfer means comprises an electrode contacted with the transfer material.

3. An image forming apparatus according to claim 2, wherein said transfer means comprises an endless belt.

4. An image forming apparatus according to claim 2, wherein said transfer means comprises an electrode roller.

5. An image forming apparatus for forming an toner image on a transfer material by using an intermediate transfer member, comprising:

a photosensitive member;

a toner image forming means for forming plural color toner images on said photosensitive member;

an intermediate transfer member contacted with said photosensitive member and shifted endlessly;

a first transfer bias power supply for applying transfer bias to a first transfer means to generate first transfer bias between said photosensitive member and said intermediate transfer member, when the plural color toner images formed on said photosensitive member is successively firstly-transferred onto said intermediate transfer member at a first transfer station of said intermediate transfer member;

a secondary transfer means for collectively secondary-transferring the toner images transferred to said intermediate transfer material onto the transfer material at a second transfer station of said intermediate transfer member; and a second transfer bias power supply connected with said secondary transfer means and using constant current for generating second transfer bias between said intermediate transfer member and said secondary transfer means;

wherein said second transfer bias power supply applies, to at least a non-image area of the transfer material at an end portion thereof in a transfer material conveying direction, in an overlap fashion, transfer bias of current having a current value greater than a current value of the transfer bias to be applied an upstream image area of the transfer material by two to ten times and having the same polarity as that of the transfer bias to be applied to the upstream image area of the transfer material.

6. An image forming apparatus according to claim 5, wherein said secondary transfer means comprises an electrode contacted with the transfer material.

7. An image forming apparatus according to claim 6, wherein said secondary transfer means comprises an endless belt.

8. An image forming apparatus according to claim 6, wherein said secondary transfer means comprises an electrode roller.

9. An image forming apparatus for forming an toner image on a transfer material by using an intermediate transfer member, comprising:

a photosensitive member;

a developing means for forming plural color toner images on said photosensitive member;

an intermediate transfer member contacted with said photosensitive member and shifted endlessly;

a first transfer bias power supply for applying transfer bias to a first transfer means to generate first transfer bias between said photosensitive member and said intermediate transfer member, when the plural color toner images formed on said photosensitive member is successively firstly-transferred onto the intermediate transfer member at a first transfer station of said intermediate transfer member;

a secondary transfer electrode for collectively secondary-transferring the toner images transferred to said intermediate transfer material onto the transfer material at a second transfer station of said intermediate transfer member; and a second transfer bias power supply connected with said secondary transfer electrode and using constant current for generating second transfer bias between said intermediate transfer member and said secondary transfer electrode;

wherein said second transfer bias power supply applies, to at least a non-image area of the transfer material at an end portion thereof in a transfer material conveying direction, in an overlap fashion, transfer bias of current having a current value greater than a current value of the transfer bias to be applied to an upstream image area of the transfer material by two to ten times and having the same polarity as that of the transfer bias to be applied to the upstream image area of the transfer material.

10. An image forming apparatus according to claim 9, wherein said secondary transfer electrode comprises an electrode contacted with the transfer material.

11. An image forming apparatus according to claim 10, wherein said secondary transfer electrode comprises an endless belt.

12. An image forming apparatus according to claim 10, wherein said secondary transfer electrode comprises an electrode roller.

13. An image forming apparatus comprising:

an image bearing member;

image forming means for forming a toner image on said image bearing member;

transfer means for electrostatically transferring the toner image formed on said image bearing member by said image forming means onto a transfer material at a transfer position; and control means for controlling an electric current flowing in said transfer means while the transfer material exists at the transfer position in order to transfer the toner image from said image bearing member to the transfer material, wherein the transfer material has a first region on which the toner image is transferred from said image bearing member, and a second region which is an end in a conveying direction of the transfer material and on which no toner image is transferred from said image bearing member, and wherein said control means makes an absolute value of the electric current flowing in said transfer means when the second region of the transfer material exists at the transfer position greater than an absolute value of the electric current flowing in said transfer means when the first region of the transfer material exists at the transfer position.

14. An image forming apparatus according to claim 13, wherein said control means constant-current-controls the electric current flowing in said transfer means.

15. An image forming apparatus according to claim 13, wherein said transfer means is provided on a side opposite to a side of said image bearing member with respect to the transfer material, and a voltage having a polarity opposite to a regularly charged polarity of toner is imposed on said transfer means.

16. An image forming apparatus according to claim 15, wherein said transfer means is movable between a first position for transferring the toner image from said image bearing member to the transfer material and a second position distant from said image bearing member relative to said first position.

17. An image forming apparatus according to claim 16, wherein said transfer means includes a belt, said belt electrostatically attracting the transfer material thereto.

18. An image forming apparatus according to claim 16, wherein said transfer means includes a roller.

19. An image forming apparatus according to claim 13, wherein said control means controls the electric current to make an absolute value of the electric current flowing in said transfer means when the second region of the transfer material exists at the transfer position greater than an absolute value of the electric current flowing in said transfer means when the first region of the transfer material exists at the transfer position by 2 to 10 times.

20. An image forming apparatus according to claim 13, wherein the second region is a trailing end of the transfer material in a conveying direction of the transfer material.

21. An image forming apparatus according to claim 13, wherein the second region is a leading end of the transfer material in the conveying direction of the transfer material.

22. An image forming apparatus according to claim 13, wherein the second region includes a leading end and a trailing end of the transfer material in the conveying direction of the transfer material.

23. An image forming apparatus according to claim 13, wherein said transfer material is paper.

24. An image forming apparatus according to any one of claims 13–23, wherein said image forming means successively forms a plurality of color toner images superimposed on each other on said image bearing member.

25. An image forming apparatus according to claim 24, wherein said plurality of color toner images formed on said image bearing member by said image forming means is electrostatically transferred onto the transfer material by said transfer means.

26. An image forming apparatus comprising:

an image bearing member for bearing a toner image;

an intermediate transfer member onto which the toner image on said image bearing member is transferred;

transfer means for electrostatically transferring the toner image on said intermediate transfer member onto a transfer material at a transfer position; and control means for controlling an electric current flowing in said transfer means while the transfer material exists at the transfer position in order to transfer the toner image from said intermediate transfer member to the transfer material, wherein the transfer material has a first region on which the toner image is transferred from said intermediate transfer member, and a second region which is an end in a conveying direction of the transfer material and on which no toner image is transferred from said intermediate transfer member, and wherein said control means makes an absolute value of the electric current flowing in said transfer means when the second region of the transfer material exists at the transfer position greater than an absolute value of the electric current flowing in said transfer means when the first region of the transfer material exists at the transfer position.

27. An image forming apparatus according to claim 26, wherein said control means constant-current-controls the electric current flowing in said transfer means.

28. An image forming apparatus according to claim 26, wherein said transfer means is provided on a side opposite to a side of said intermediate transfer member with respect to the transfer material, and a voltage having a polarity opposite to a regularly charged polarity of toner is imposed on said transfer means.

29. An image forming apparatus according to claim 28, wherein said transfer means is movable between a first position for transferring the toner image from said intermediate transfer member to the transfer material and a second position distant from said intermediate transfer member relative to said first position.

30. An image forming apparatus according to claim 29, wherein said transfer means includes a belt, said belt electrostatically attracting the transfer material thereto.

31. An image forming apparatus according to claim 29, wherein said transfer means includes a roller.

32. An image forming apparatus according to claim 26, wherein said control means controls the electric current to make an absolute value of the electric current flowing in said transfer means when the second region of the transfer material exists at the transfer position greater than an absolute value of the electric current flowing in said transfer means when the first region of the transfer material exists at the transfer position by 2 to 10 times.

33. An image forming apparatus according to claim 26, wherein the second region is a trailing end of the transfer material in the conveying direction of the transfer material.

34. An image forming apparatus according to claim 26, wherein the second region is a leading end of the transfer material in the conveying direction of the transfer material.

35. An image forming apparatus according to claim 26, wherein the second region includes a leading end and a trailing end of the transfer material in the conveying direction of the transfer material.

36. An image forming apparatus according to claim 26, wherein said transfer material is paper.

37. An image forming apparatus according to claim 26, wherein said intermediate transfer member includes an elastic layer.

38. An image forming apparatus according to any one of claims 26–37, wherein said image forming apparatus repeatedly forms a toner image on said image bearing member onto said intermediate transfer member to form a plurality of color toner images on said intermediate transfer member, and said plurality of color toner images formed on said intermediate transfer member is electrostatically transferred onto the transfer material by said transfer means.

* * * * *

UNITED STATES PATENT AND TRADEMARK OFFICE

CERTIFICATE OF CORRECTION

PATENT NO. : 5,974,281

DATED : October 26, 1999

INVENTOR(S): HARUO FUJII, ET AL.

It is certified that error appears in the above-identified patent and that said Letters Patent is hereby corrected as shown below:

COVER PAGE AT ITEM [56]:
U.S. Patent Documents: Insert:
--5,177,549 1/1993 Ohtsuka, et al.
5,198,863 3/1993 Goto, et al.
5,264,902 11/23/93 Suwa, et al.
5,285,245 2/1994 Goto, et al.
5,666,597 9/1997 Sasame, et al.--

COLUMN 1:
Line 53, "firstly" should read --first--.

COLUMN 3:
Line 2, "PREFORMED" should read --PREFERRED--;
Line 40, "firstly" should read --first--;
Line 45, "firstly" should read --first--; and
Line 47, "firstly" should read --first--.

COLUMN 4:
Line 13, "(firstly" should read --(first--;
Line 17, "(firstly" should read --(first--;
Line 18, "firstly" should read--first--;
Line 19, "firstly" should read --first--;
Line 38, "as" should be deleted; and
Line 39, firstly" (both occurrences) should read --first--.

UNITED STATES PATENT AND TRADEMARK OFFICE

CERTIFICATE OF CORRECTION

PATENT NO. : 5,974,281

DATED : October 26, 1999

INVENTOR(S): HARUO FUJII, ET AL.

It is certified that error appears in the above-identified patent and that said Letters Patent is hereby corrected as shown below:

COLUMN 9:

Line 11, "in an" should read --in a--; and

Line 40, "an toner" should read --a toner--.

COLUMN 10:

Line 5, "an toner" should read --a toner--;

Line 17, "member is" should read --member are--;

Line 37, "applied an" should read --applied to an--;

Line 51, "an toner" should read --a toner--; and

Line 64, "member is" should read --member are--.

Signed and Sealed this

Thirty-first Day of October, 2000

*Attest:*

*Attesting Officer*

Q. TODD DICKINSON

*Director of Patents and Trademarks*